US007241116B2

(12) United States Patent
Tarutani et al.

(10) Patent No.: US 7,241,116 B2
(45) Date of Patent: Jul. 10, 2007

(54) METHOD OF ADJUSTING ROTARY MACHINE

(75) Inventors: Tomoji Tarutani, Kariya (JP); Masahiro Kawaguchi, Kariya (JP); Yoshinori Inoue, Kariya (JP); Kenji Mochizuki, Kariya (JP); Hisato Kawamura, Kariya (JP)

(73) Assignee: Kabushiki Kaisha Toyota Jidoshokki, Kariya-shi (JP)

( * ) Notice: Subject to any disclaimer, the term of this patent is extended or adjusted under 35 U.S.C. 154(b) by 531 days.

(21) Appl. No.: 10/729,308

(22) Filed: Dec. 4, 2003

(65) Prior Publication Data

US 2004/0136834 A1 Jul. 15, 2004

(30) Foreign Application Priority Data

Dec. 5, 2002 (JP) ..... P2002-354202

(51) Int. Cl.
*F04B 1/12* (2006.01)

(52) U.S. Cl. ..... 417/269

(58) Field of Classification Search ..... 417/269; 92/71; 29/525

See application file for complete search history.

(56) References Cited

U.S. PATENT DOCUMENTS 4,613,240 A 9/1986 Hagelthorn ..... 384/585
4,913,565 A 4/1990 Englund ..... 384/617
2001/0021348 A1* 9/2001 Ota et al. ..... 417/222.2

FOREIGN PATENT DOCUMENTS

| | | |
|---|---|---|
| EP | 1 122 428 A2 | 8/2001 |
| EP | 1 167 764 A2 | 1/2002 |
| JP | 05-113174 | 5/1993 |
| JP | 07-119631 | 5/1995 |
| JP | 2001-263228 | 9/2001 |

* cited by examiner

*Primary Examiner*—Anthony Stashick
*Assistant Examiner*—Vikansha Dwivedi
(74) *Attorney, Agent, or Firm*—Morgan & Finnegan, L.L.P.

(57) ABSTRACT

A method of adjusting a rotary machine includes the steps of press fitting an adjustable member to one of a housing and a rotary body where the adjustable member is arranged to a reference position at which movable amount or a rotary body is zero, and adjusting the movable amount of the rotary body in a direction of a rotary axis to the predetermined amount by varying a position of the adjustable member that is press-fitted to the one of the housing and the rotary body from the reference position by the predetermined amount in a direction in which the movement restricting part and the contacting part contacting with each other are separated from each other.

7 Claims, 5 Drawing Sheets

METHOD OF ADJUSTING ROTARY MACHINE

BACKGROUND OF THE INVENTION

The present invention relates to a rotary machine, such as a refrigerating compressor for use in a vehicle air conditioning apparatus, and more particularly, to a method of adjusting movable amount in a direction of a rotary axis of a rotary body for use in the rotary machine to a predetermined amount.

Japanese Unexamined Patent Publication No. 2001-263228 as a referenced publication discloses a piston-type refrigerating compressor for use in a vehicle air conditioning apparatus. (See pages 7 to 10 of the referenced publication and FIGS. 1 to 3 of the referenced publication). In FIGS. 7A and 7B, a left side of each drawing is a front side and a right side thereof is a rear side. Referring to FIG. 7A, a rotary shaft 81 is rotatably supported in a housing 80 of the refrigerating compressor and is slidable along the direction of a rotary axis L thereof. In the housing 80, a compression mechanism is accommodated and includes a lug plate 82, a swash plate 83 and a piston 84. An engine, which serves as a drive source for use in a vehicle, drives the rotary shaft 81 and thereby the lug plate 82 and the swash plate 83 are rotated together with the rotary shaft 81. Therefore, a piston 84 is reciprocated in a cylinder bore 85 and thereby refrigerant gas is compressed. In the housing 80, a sealing member 98, which is placed on a side of the rotary shaft 81 that protrudes outside the housing 80, thereby prevents refrigerant from leaking along the rotary shaft 81 outside the housing 80.

The refrigerating compressor includes means for restricting movable amount of the rotary shaft 81 in tho direction of tho rotary axis L to a predetermined amount that is extremely short, such as a length of 0.1 mm. The means is hereinafter referred to movement restricting means. Also, the movable amount is hereinafter referred to a thrust clearance. Specifically, frontward sliding movement of the rotary shaft 81 in the direction of the rotary axis L is restricted in a slate that the lug plate 82 that is integrated with the rotary shaft 81 contacts with an inner wall surface 87 of the housing 80 through a thrust bearing 86. On the other hand, rearward sliding movement of the rotary shaft 81 in the direction of the rotary axis L is restricted when an outer circumferential portion 88*a* of a rear end surface 88 of the rotary shaft 81 contacts with a front end surface 90 of an adjustable member 89 that is fixedly press-fitted into the housing 80.

Thus, when the thrust clearance of the rotary shaft 81 is adjusted to the predetermined amount extremely short, sealing defect of the sealing member 98 caused by sliding movement of the rotary shaft 81 is prevented.

As shown in FIG. 7B, in the prior art, when the adjustable member 89 is press-fitted into the housing 80, and when the thrust clearance of the rotary shaft 81 is adjusted to a predetermined amount X1, a jig 92 that is exclusive for press fit is used.

Specifically, the jig 92 includes a body 93 that has cylindrical shape and a clearance adjusting part 94 for adjusting a clearance. The clearance adjusting part 94 extends from the front end surface of the body 93. The diameter of the clearance adjusting part 94 is smaller than that of the body 93. In the front end surface of the body 93, a part of the front end surface of the body 93 that forms a step by the body 93 and the clearance adjusting part 94 is a pressing portion 95. In the jig 92, the length of the clearance adjusting part 94, that is, the distance in the direction of the rotary axis L between the pressing portion 95 and the front end surface of the clearance adjusting part 94, is sent to be equal to the sum of thickness Y of the adjustable member 89 and the predetermined amount X1 of the thrust clearance of the rotary shaft 81.

A through hole 96 extends through the adjustable member 89 in the direction of the rotary axis L. When the jig 92 is used, the clearance adjusting part 94 is inserted from the rear side of the through hole 96. In this state, the pressing portion 95 is pressed against the rear end surface 97 of the adjustable member 89. Thereby, the adjustable member 89 is pressed toward the rotary shaft 81 and the front end surface of the clearance adjusting part 94 is pressed to a middle portion 88*b* of the rear end surface 88 of the rotary shaft 81.

Therefore, the rotary shaft 81 is frontward pressed in the direction of the rotary axis L, and the frontward sliding movement in the direction of the rotary axis L of the rotary shaft 81 is restricted in the state that the lug plate 82 contacts with the inner wall surface 87 of the housing 80 through the thrust bearing 86. In this state, the clearance adjusting part 94 of the jig 92 protrudes from the front end surface 90 of the adjustable member 89 by the predetermined amount X1 toward the rotary shaft 81. Therefore, the distance between the rear end surface 88 of the rotary shaft 81 and the front end surface 90 of the adjustable member 89, that is, the thrust clearance of the rotary shaft 81, is set to the predetermined amount X1.

In the method of adjusting the thrust clearance of the rotary shaft 81 according to the aforementioned prior art, however, the clearance adjusting part 91 of the jig 92 is contacted with the middle portion 88*b* of the rear end surface 88 of the rotary shaft 81. That is, the clearance adjusting part 94 of the jig 92 is contacted with the middle portion 88*b* of the rear end surface 88 different from the outer circumferential portion 88*a* of the rear end surface 88, which contacts with the adjustable member 89. Therefore, manufacturing quality of the rear end surface 88 of the rotary shaft 81, that is, manufacturing quality of the outer circumferential portion 88*a* and the middle portion 88*b*, affects the thrust clearance of the rotary shaft 81. Thereby, the thrust cl aranc of the rotary shaft 81 is not set in high accuracy.

Namely, in a state of FIG. 7B, even if the distance between the middle portion 88*b* of the rear end surface 88 and the front end surface 90 of the adjustable member 89 is set to the predetermined amount X1, the distance between the outer circumferential portion 88*a* that is an actual contacting portion and the front end surface 90 is deviated from the predetermined amount X1 owing to the manufacturing quality of the rear end surface 88.

Also, in the method of adjusting the thrust clearance of the rotary shaft 81 according to the aforementioned prior art, the pressing portion 95 of the jig 92 is contacted with the rear end surface 97 of the adjustable member 89. In addition, the clearance adjusting part 94 of the jig 92 is inserted into the adjustable member 89 and is contacted with the rear end surface 88 of the rotary shaft 81. Therefore, manufacturing quality of the adjustable member 89 also affects the thrust clearance of the rotary shaft 81. Especially, the manufacturing quality of the thickness of the adjustable member 89 affects the thrust clearance of the rotary shaft 81.

SUMMARY OF THE INVENTION

The present invention is directed to a method of adjusting a rotary machine which accurately sets movable amount of a rotary body.

The present invention has the following first feature. A rotary machine includes a housing, a rotary body, movement restricting means and an adjustable member. The rotary body is rotatably supported in the housing and has a rotary axis for rotation. The movement restricting means restricts movable amount of the rotary body in a direction of the rotary axis to a predetermined amount when the movement restricting means contacts with the rotary body. The movement restricting means also restricts one-side sliding movement of the rotary body in the direction of the rotary axis when a movement restricting part and a contacting part contact with each other. One of the movement restricting part and the contacting part is provided by the adjustable member that is fixedly press-fitted to one of the housing and the rotary body in the direction of the rotary axis. A method of adjusting the rotary machine includes the steps of press fitting the adjustable member to one of the housing and the rotary body where the adjustable member is arranged, to a reference position at which movable amount of the rotary body is zero, and adjusting the movable amount of the rotary body in the direction of the rotary axis to the predetermined amount by varying a position of the adjustable member that is press-fitted to the one of the housing and the rotary body from the reference position by the predetermined amount in a direction in which the movement restricting part and the contacting part contacting with each other are separated from each other.

The present invention has the following second feature. A piston type compressor includes a housing, a piston, a rotary shaft, a passage, a rotary valve, a compression mechanism and movement restricting means. The housing defines a cylinder bore, a suction pressure region and a valve accommodation chamber that has an inner circumferential surface. The piston is accommodated in the cylinder bore. The rotary shaft is rotatably supported in the housing. The rotary shaft is connected to the piston in such a manner that the rotation of the rotary shaft is converted into reciprocation of the piston. The rotary shaft has a rotary axis for rotation and an end. The passage is formed between the cylinder bore and the suction pressure region. The rotary valve is rotatably accommodated in the valve accommodation chamber. The rotary valve is fixedly press-fitted to the end of the rotary shaft to form a rotary body. The rotary valve opens and closes the passage in accordance with synchronous rotation of the rotary shaft. The rotary valve has an outer circumferential surface. The outer circumferential surface of the rotary valve and the inner circumferential surface of the valve accommodation chamber constitute a slide-bearing surface. The end of the rotary shaft is rotatably supported in the housing through the rotary valve. The compression mechanism is accommodated in the housing for compressing refrigerant gas based on the reciprocation of the piston. The movement restricting means restricts movable amount of the rotary body to a predetermined amount in a direction of the rotary axis when the movement restricting means contacts with the rotary body. One-side sliding movement of the rotary body in the direction of the rotary axis is restricted when a movement restricting part and a contacting part contact with each other. One of the movement restricting part and the contacting part is provided by an adjustable member that is fixedly press-fitted to one of the housing and the rotary body in the direction of the rotary axis.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
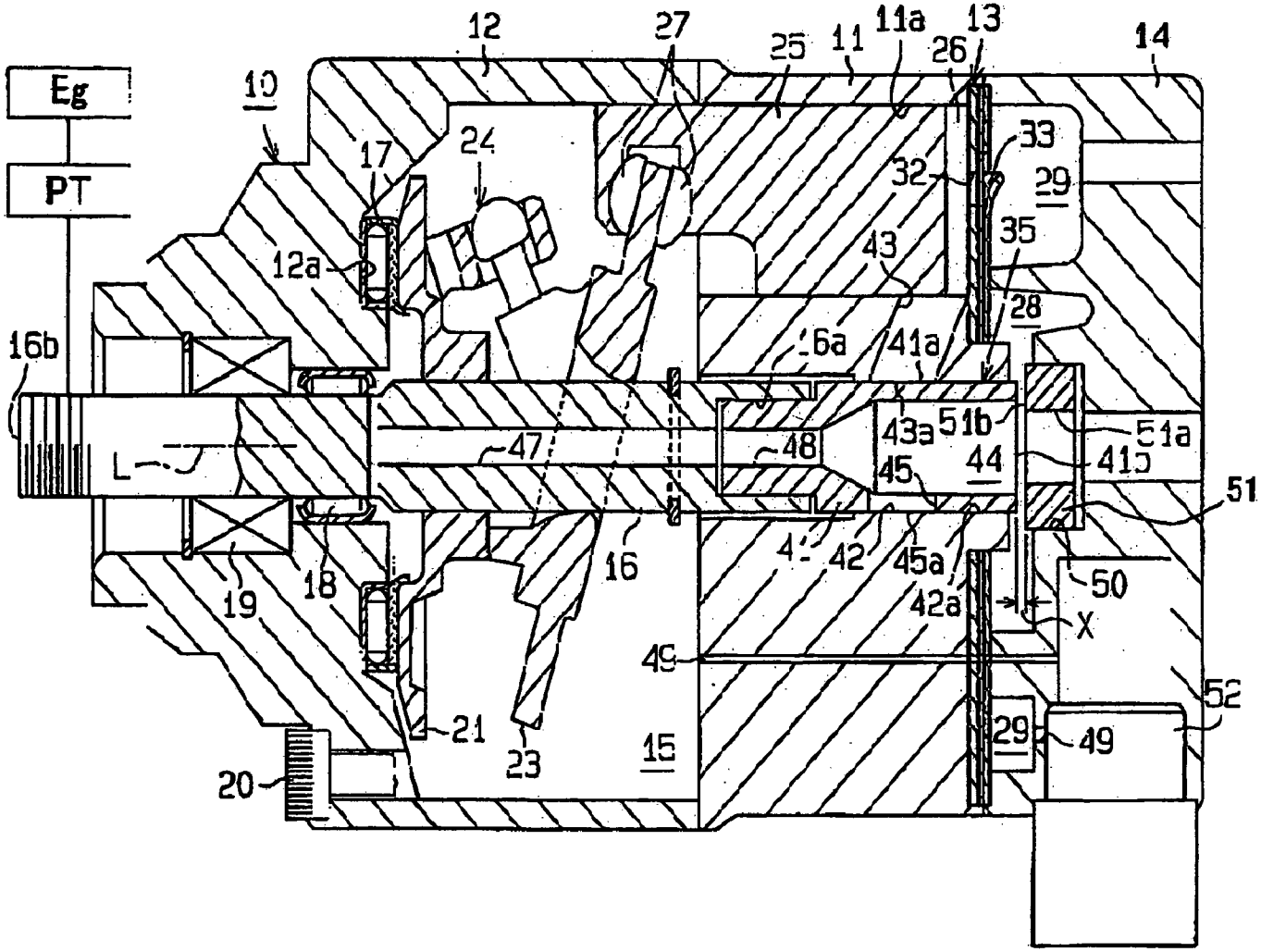
FIG. 1 is a longitudinal sectional view illustrating a variable displacement piton type compressor that is applied to a first preferred embodiment of the present invention.

A method of adjusting a rotary machine according to a first preferred embodiment of the present invention will now be described with reference to FIGS. 1 and 2A through 2C. In the first embodiment, a variable displacement piston type compressor for use in a vehicle air conditioning apparatus is adopted as the rotary machine. In each of FIGS. 1 through 2C, a left side of the drawing is a front side and a right side thereof is a rear side.

As shown in FIG. 1, a variable displacement piston type compressor (hereinafter the compressor) includes a front housing 12, a cylinder block 11 and a rear housing 14. The rear end of the front housing 12 is fixedly joined to the front end of the cylinder block 11. The rear end of the cylinder block 11 is fixedly joined to the front end of the rear housing 14 through a valve plate assembly 13. The front housing 12, the cylinder block 11 and the rear housing 14 are made of metallic material of aluminum series and are fixedly bolted by a plurality of through bolts 20 to form a compressor housing 10. In FIG. 1, only one through bolt 20 is illustrated.

Each of the front housing 12, the cylinder block 11 and the rear housing 14 is a housing component for constituting the compressor housing 10. Specifically, the cylinder block 11 and the rear housing 14 are respectively considered as a first housing component and a second housing component.

The front housing 12 and the cylinder block 11 define a crank chamber 15. In the crank chamber 15, a rotary shaft 16 serves as a rotary body and is made of metallic material of iron series. The rotary shaft 16 is connected to an engine Eg, which is a driving source for running a vehicle, through a power transmission mechanism PT for operation. The rotary shaft 16 receives power of the engine Eg and is thereby rotated. The driving source is an external drive source. The front end of the rotary shaft 16 is rotatably supported by a radial bearing 18 in the front housing 12. The radial bearing 18 is a roller bearing. A shaft seal 19 is interposed between the front housing 12 and the rotary shaft 16.

A lug plate 21 is fixed to the rotary shaft 16 so as to integrally rotate with the rotary shaft 16 in the crank chamber 15. A thrust bearing 17 is interposed between the lug plate 21 and an inner wall surface 12*a* of the front housing 12.

In the crank chamber 15, a swash plate 23 that serves as a cam plate is accommodated. The swash plate 23 is supported by the rotary shaft 16 so as to slide along a rotary axis L of the rotary shaft 16. The swash plate 23 inclines at an inclination angle, which is variable, with a plane perpendicular to the rotary axis L of the rotary shaft 16. Also, a hinge mechanism 24 is interposed between the lug plate 21 and the swash plate 23. Thus, since the swash plate 23 is connected to the lug plate 21 through the hinge mechanism 24 and is supported by the rotary shaft 16, the swash plate 23 is synchronously rotated with the lug plate 21 and the rotary shaft 16. In addition, the swash plate 23 is inclinable relative to the plane perpendicular to the rotary axis L of the rotary shaft 16, while being capable of sliding along the rotary axis L of the rotary shaft 16.

A plurality of cylinder bores 11*a* is formed through the cylinder block 11 so as to surround a rear side of the rotary shaft 16. In FIG. 1, only one cylinder bore 11*a* is illustrated. A single-head piston 25 (hereinafter the piston 25) is accommodated in each cylinder bore 11*a* for reciprocation. A front opening of each cylinder bore 11*a* is blocked by the corresponding piston 25 while a rear opening thereof is blocked by the valve plate assembly 13. Thus, a compression chamber 26 is defined in each cylinder bore 11*a* and volume of the compression chamber 26 is varied in accordance with the reciprocation of the piston 25. Each piston 25 is engaged with a periphery of the swash plate 23 through a pair of shoes 27. Therefore, the rotation of the swash plate 23, which is accompanied by the rotation of the rotary shaft 16, is converted to the reciprocation of each piston 25 through the corresponding shoes 27.

In the rear housing 14, a suction chamber 28 and a discharge chamber 29 are defined. The suction chamber 28 and the discharge chamber 29 respectively serve as a suction pressure region and a discharge pressure region. The suction chamber 28 is formed in the middle of the rear housing 14 and the discharge chamber 29 is formed so as to surround the periphery of the suction chamber 28. Each compression chamber 26 and the discharge chamber 29 are in communication via a discharge port 32 that extends through the valve plate assembly 13. A discharge valve 33 that is included in the valve plate assembly 13 opens and closes each discharge port 32. The discharge valve 33 is a reed valve. In the cylinder block 11, a suction valve system mechanism 35 is placed and includes a rotary valve 41.

While each piston 25 moves from a top dead center to a bottom dead center, refrigerant gas in the suction chamber 28 is drawn into the corresponding compression chamber 26 through the suction valve system mechanism 35. The movement of the piston 25 is a suction stroke. On the other hand, while each piston 25 moves from the bottom dead center to the top dead center, the refrigerant gas that is drawn into the corresponding compression chamber 26 is compressed to a predetermined pressure level and is discharged to the discharge chamber 29 through the corresponding discharge port 32 pushing the corresponding discharge valve 33 away. The movement of the piston 25 is a discharge stroke.

In the middle of the cylinder block 11, a valve accommodation chamber 42 that has cylindrical shape is formed and is surrounded by the cylinder bores 11*a*. The valve accommodation chamber 42 communicates with the suction chamber 28 on the rear side thereof. In the cylinder block 11, a plurality of suction communication passages 43 is formed. The valve accommodation chamber 42 and each compression chamber 26 are in communication via the corresponding suction communication passage 43. In FIG. 1, only one suction communication passage 43 is illustrated.

In the valve accommodation chamber 42, a rotary valve 41 is rotatably accommodated. The rotary valve 41 is made of metallic material of aluminum series and substantially has a cylindrical shape. The rear end surface of the rotary valve 41 protrudes from the valve accommodation chamber 42, that is, the cylinder block 11, into the suction chamber 28. That is, the rear end surface of the rotary valve 41 is placed in the suction chamber 28.

The rear end of the rotary shaft 16 is placed in the valve accommodation chamber 4. In the rear end of the rotary shaft 16, a recess 16*a* is formed and the rotary valve 41 is fixedly press-fitted to the recess 16*a*. Thus, the rotary valve 41 and the rotary shaft 16 are integrated with each other to form a single rotary axis, that is, the rotary axis L. The rotary valve 41 is synchronously rotated with the rotation of the rotary shaft 16. That is, the rotary valve 41 is synchronously rotated with the reciprocation of the piston 25.

An outer circumferential surface 41*a* of the rotary valve 41 and an inner circumferential surface 42*a* of the rotary valve accommodation chamber 42 constitute a slide-bearing surface in order to rotatably support the rotary valve 41 in the valve accommodation chamber 42. Namely, the rear end of the rotary shaft 16 is rotatably supported in the cylinder block 11 through the rotary valve 41.

In the rotary valve 41, an internal space 44 extends along the direction of the rotary axis L and communicates with the suction chamber 28. In the rotary valve 41, an introduction passage 45 is formed for interconnecting the internal space 44 with the outer circumferential surface side of the rotary valve 41. An outlet 45*a* of the introduction passage 45 is opened to the outer circumferential surface 41*a* of the rotary valve 41. As the rotary valve 41 or the rotary shaft 16 rotates, the outlet 45*a* of the introduction passage 45 intermittently communicates with an inlet 43*a* of the suction communication passage 43 of the cylinder block 11. That is, when the rotary valve 41 is synchronously rotated with the rotary shaft 16, the rotary valve 41 is capable of opening and closing refrigerant passages between the cylinder bores 11*a* and the suction chamber 28.

In the suction stroke of the cylinder bore 11*a*, the outlet 45*a* of the introduction passage 45 communicates with the inlet 43*a* of the suction communication passage 43. Therefore, refrigerant in the suction chamber 28 is introduced into the corresponding compression chamber 26 of the cylinder bore 11*a* through the internal space 44, the introduction passage 45 and the suction communication passage 43 in the suction stroke.

On the other hand, in the discharge stroke of the cylinder bore 11*a*, communication between the outlet 45*a* of the introduction passage 45 and the inlet 43*a* of the suction communication passage 43 is blocked. Therefore, refrigerant in the compression chamber 26 is discharged to the discharge chamber 29 thorough the corresponding discharge port 32 pushing the corresponding discharge valve 33 away in the discharge stroke.

A through hole 47 extends through the rotary shaft 16 and communicates with the internal space 44 through a port 48 that is formed in the rotary valve 41. The suction chamber 28 communicates with the crank chamber 15 through the internal space 44, the port 48 and the through hole 47.

The discharge chamber 29 and the crank chamber 15 are in communication via a pressure supplying passage 49. In the pressure supplying passage 49, a displacement control valve 52 is placed. The displacement control valve 62 controls an amount of refrigerant that flows from the discharge chamber 29 to the crank chamber 15. Refrigerant in the crank chamber 15 flows into the suction chamber 28 through the through hole 47, the port 48 and the internal space 44. As the pressure in the crank chamber 15 increases, the inclination angle of the swash plate 23 becomes small. In contrast, as the pressure in the crank chamber 15 decreases, the inclination angle of the swash plate 23 becomes large. The displacement control valve 52 adjusts the pressure in the crank chamber 15 in order to control the inclination angle of the swash plate 23.

In the aforementioned structure, the rotary shaft 16, the lug plate 21, the rotary valve 41, the swash plate 23, the shoes 27 and the pistons 25 constitute a compression mechanism for compressing the refrigerant.

Now, means for restricting movable amount of the rotary shaft 16 in the direction of the rotary axis L to a predetermined amount will be described. The movable amount of the rotary shaft 16 is restricted when the means contacts with the rotary shaft 16. The means is hereinafter referred to movement restricting means.

While the compressor runs, compressive load of the refrigerant gas that is applied to each piston 25 is received by the inner wall surface 12*a* of the front housing 12 through the shoes 27, the swash plate 23, the hinge mechanism 24, the lug plate 21 and the thrust bearing 17. That is, frontward sliding movement of an integral body that includes the rotary shaft 16, the lug plate 21, the swash plate 23 and the pistons 25 due to the compressive load in the direction of the rotary axis L is restricted by contacting the inner wall surface 12*a* of the front housing 12 through the lug plate 21 and the thrust bearing 17. Therefore, the inner wall surface 12*a* of the front housing 12 is considered as a component of the movement restricting means.

In the suction chamber 28 of the rear housing 14, an insertion hole 50 is formed so as to have a cylindrical inner surface whose central axis is on the rotary axis L. In the insertion hole 50, a cylindrical adjustable member 51 is fixedly press-fitted. The adjustable member 51 is made of metallic material of aluminum series and is separately formed from the rear housing 14. In the present embodiment, allowance of press-fitting between the rotary valve 41 and the rotary shaft 16 is set to be larger than that between the adjustable member 51 and the insertion hole 50. Therefore, strength of press-fitting between the rotary valve 41 and the rotary shaft 16 is set to be larger than that between the adjustable member 51 and the insertion hole 50.

In the middle of the adjustable member 51, an insertion hole 51*a* is formed through the adjustable member 51 and thereby permits the refrigerant gas in an external refrigerant circuit to be introduced into the auction chamber 28. In the adjustable member 51, a front end surface of the adjustable member 51 that faces a rear end surface of the rotary valve 41 in the suction chamber 20 serves as a movement restricting part 51*b*. Also, the rear end surface of the rotary valve 41 serves as a contacting part 41*b*. When the movement restricting part 51*b* contacts with the contacting part 41*b*, rearward sliding movement of the rotary shaft 16 in the direction of the rotary axis L is restricted. Therefore, each of the movement restricting part 51*b* and the contacting part 41*b* is considered as a component of the movement restricting means.

In a state that the frontward sliding movement of the rotary shaft 16 is restricted by contacting the lug plate 21 with the inner wall surface 12*a* through the thrust bearing 17, a predetermined amount of clearance that is formed between the contacting part 41*b* and the movement restricting part 51*b* is defined as X. The predetermined amount X is equivalent to the movable amount of the rotary shaft 16. The predetermined amount X is set so as to permit the rotation of the rotary shaft 16 in the compressor housing 10. At the same time, the predetermined amount X is set so as to satisfactorily suppress slippage of a position, at which the rotary shaft 16 contacts with the shaft seal 19. The slippage of the position is caused by the sliding movement of the rotary shaft 16. The predetermined amount X is about 0.1 mm and is exaggeratedly drawn in all of the drawings.

Figure 2A:
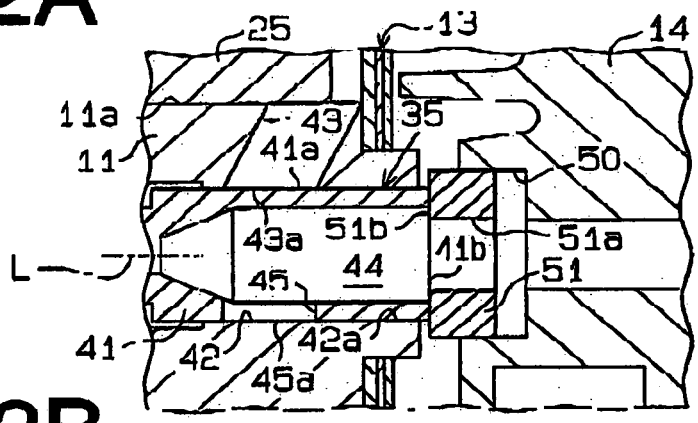
FIGS. 2A, 2B and 2C are views illustrating a procedure for adjusting the variable displacement piton type compressor according to the first preferred embodiment of the present invention.
Figure 2B:
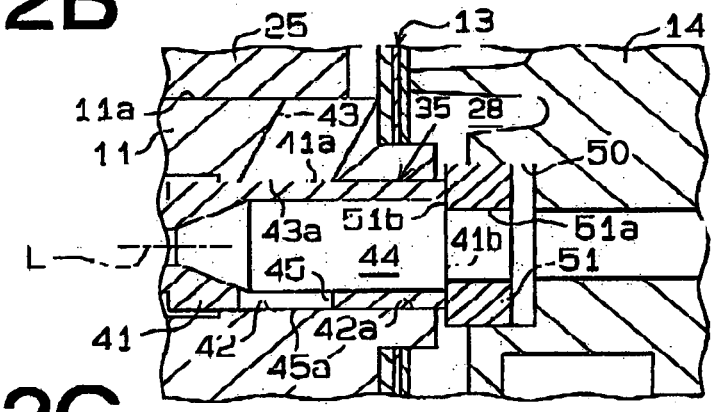
Figure 2C:
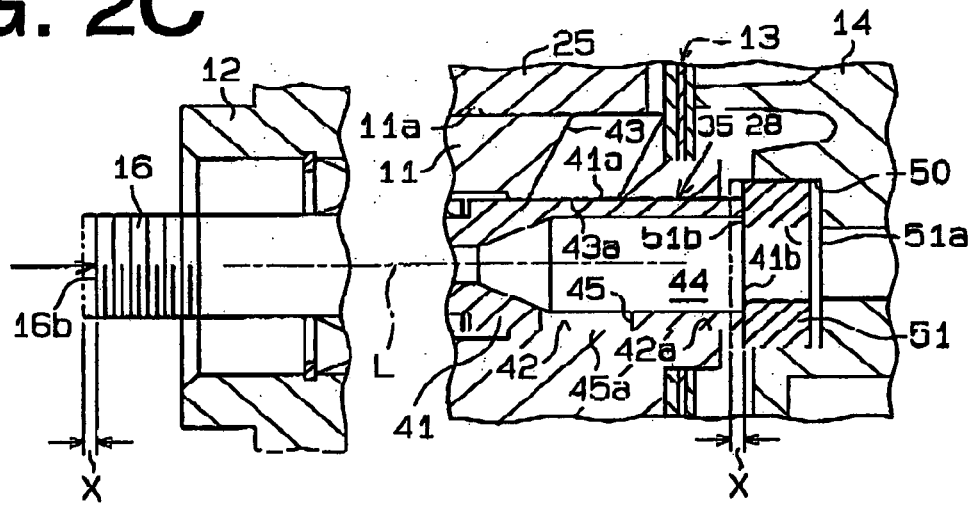

Now, in the aforementioned compressor, a process of adjusting the predetermined amount X will be described. FIGS. 2A through 2C are partially enlarged views of the compressor. Thereby, a process of installing the rear housing 14 on the cylinder block side is illustrated. Note that in the aforementioned compression mechanism the rear housing 14 has already installed on the cylinder block side.

When the rear housing 14 is installed on the cylinder block side, or the first housing component side, the adjustable part 51 is first press-fitted into the insertion hole 50 to a shallow position compared to a finished state that the rear housing 14 is joined to the cylinder block 11.

As shown in FIG. 2A, in a state that the front end surface of the rear housing 14 is arranged so as to face the rear end surface of the cylinder block 11, the rear housing 14 and the cylinder block 11 are arranged in such a manner that the movement restricting part 51*b* of the adjustable member 51 contacts with the contacting part 41*b* of the rotary valve 41. Note that in FIG. 2A the rear housing 14 does not contact with the cylinder block 11.

In the state of FIG. 2A, the rear housing 14 is fixedly joined to the cylinder block side by bolting the through bolt 20, which is shown in FIG. 1, in such a manner that the movement restricting part 51*b* of the adjustable member 51 is pressed against the contacting part 41*b* of the rotary valve 41 in the direction of the rotary axis L. That is, bolting the through bolt 20 enables the rear housing 14 to be pressed toward the cylinder block 11 in such a manner that the rear housing 14 contacts with the cylinder bore 11. When the rear housing 14 is pressed toward the cylinder block 11, the frontward sliding movement of the rotary shaft 16 is restricted by the inner wall surface 12*a* of the front housing 12 through the lug plate 21. Because the contacting part 41*b* of the rotary valve 41 presses against the movement restricting part 51*b* of the adjustable member 51, a position of the adjustable member 51 that is press-fitted into the insertion hole 50 in the state of FIG. 2A is rearward varied by the pressing amount of the contacting part 41*b*. The aforementioned means is a first process.

Thus, as shown in FIG. 2B, in a state that the movement restricting part 51*b* of the adjustable member 51 contacts with the contacting part 41*b* of the rotary valve 41, the rear housing 14 is fixedly joined to the cylinder block 11. That is, in the state, the position of the adjustable member 51 that is press-fitted into the insertion hole 50 is temporality set to a reference position in such a manner that the sliding movement of the rotary shaft 16 is restricted, namely, the movable amount of the rotary shaft 16 becomes zero in the direction of the rotary axis L.

In the present embodiment, the strength of press-fitting between the rotary valve 11 and the rotary shaft 16 is set to be larger than that between the adjustable member 51 and the insertion hole 50. Therefore, in the above first process, even when pressing force generates between the adjustable member 51 and the rotary valve 41, a position of the rotary valve 41 that is press-fitted into the rotary shaft 16, or a depth thereof, is not varied, but a position of the adjustable member 51 that is press-fitted into the insertion hole 50, or a depth thereof, is varied.

As shown in FIG. 2C, when a front end surface 16*b* of the rotary shaft 16 that protrudes outside the compressor housing 10 is rearward pressed, the rotary shaft 16 is moved to the compressor housing 10 by the predetermined amount X so as to slide along the direction of the rotary axis L. The aforementioned means is a second process. In FIG. 2C, a position of the rotary shaft 16 of FIG. 2B is shown by two-dot chain line. Therefore, when the contacting part 41*b* of the rotary valve 41 presses against the movement restricting part 51*b* of the adjustable member 51, the adjustable member 51 is press-fitted into the insertion hole 50 rearward by the predetermined amount X. Thus, the predetermined amount X is formed between the movement restricting means and the rotary shaft 16. The above operation that the rotary shaft 16 is rearward pressed is achieved by an automatic machine including a screw feed mechanism.

In the present embodiment, the following advantageous effects are obtained.

(1) In the first process, the adjustable member 51 is pressed against the rear housing 14 to the reference position at which the movable amount of the rotary shaft 16 is zero in the direction of the rotary axis L. That is, in a state that actual contacting portions of the movement restricting means contact with each other, the reference position of the adjustable member 51, or a zero-point position thereof, is defined. Therefore, in the second process, if the position of the adjustable member 51 that is press-fitted into the insertion hole 50 is varied from the reference position by the predetermined amount X in a direction in which the movement restricting part 51*b* and the contacting part 41*b* contacting with each other are separated from each other, the movable amount of the rotary shaft 16 is accurately adjusted to the predetermined amount X. Namely, the movable amount of the rotary shaft 16 is not affected by the manufacturing quality of the movement restricting part 51*b* and the contacting part 41*b*, and is accurately adjusted to the predetermined amount X.

(2) In the second process, the rotary shaft 16 is pressed against the movement restricting part 51*b* by the predetermined amount X. Namely, the adjustable member 51 is pressed by the contacting part 41*b*, and thereby the position of the adjustable member 51 that is press-fitted into the insertion hole 50 is varied from the reference position by the predetermined amount X in the direction in which the movement restricting part 51*b* and the contacting part 41*b* contacting with each other are separated from each other. That is, in the second process, the adjustable member 51 is not directly pressed by a tool for press fit, but is indirectly pressed through the rotary shaft 16 and the rotary valve 41. Therefore, even if the compressor is structured in such a manner that the adjustable member 51 is placed at a position at which it is hard to insert the tool, the second process is easily achieved.

(3) Since the compressor receives power from the engine Eg, a part of the rotary shaft 16 is exposed outside from the compressor housing 10. In the second process, when the rotary shaft 16 is pressed, the exposed part of the rotary shaft 16, that is, the front end surface 16*b* is pressed. Therefore, even in a state that the compressor housing 10 is completely assembled, or even in a state that the adjustable member 51 is not exposed outside from the compressor housing 10, the second process is achieved. Thereby, in a state that a procedure for assembling a prior art compressor is hardly changed, that is, in a state that an equipment for manufacturing the prior art compressor is hardly changed, the position of the adjustable member 51 that is press-fitted into the insertion hole 50 is varied from the reference position by the predetermined amount X in the direction in which the movement restricting part 51*b* and the contacting part 41*b* contacting with each other are separated from each other.

(4) The cylinder block 11 and the rear housing 14 are fixedly joined to each other, and thereby the adjustable member 51 is pressed. That is, the first process is simultaneously achieved with the joining process. Namely, the method of adjusting the compressor according to the present embodiment does not require an exclusive first process. Thereby, the movable amount of the rotary shaft 16 is adjusted at low cost.

(5) If the movable amount is excessively adjusted in the direction of the rotary axis L, it is afraid that the outlet 45*a* of the introduction passage 45 and the inlet 43*a* of the suction communication passage 43 in the suction valve system mechanism 35 are largely deviated from each other in the direction of the rotary axis L. Due to the case, an amount of the refrigerant gas that is introduced from the suction chamber 28 to each cylinder bore 11*a* is reduced. Thus, the function for introducing the refrigerant gas is hindered. Therefore, it is especially effective that the present embodiment is applied to the suction valve system mechanism 35 including the rotary valve 41 and that thereby accuracy for adjusting the movable amount of the rotary shaft 16 is improved.

(6) The outer circumferential surface 41*a* of the rotary valve 41 and the inner circumferential surface 42*a* of the valve accommodation chamber 42 constitute the slide-bearing surface in order to rotatably support the rotary valve 41 in the valve accommodation chamber 42. The rotary shaft 16 and the rotary valve 41 constitute an integrated structure in such a manner that the rear end of the rotary shaft 16 is rotatably supported in the compressor housing 10 through the rotary valve 41. When the integrated structure receives radial external force from the inner circumferential surface 42*a* of the valve accommodation chamber 42, the rotary valve 41 serves as a supporting portion for supporting the radial external force.

Namely, in such a structure, the strength of press-fitting between the rotary valve 41 and the rotary shaft 16 is required to become sufficient strength against the above-mentioned external force. Therefore, relatively large force is needed in order to adjust the position of the rotary valve 41 that is press-fitted into the rotary shaft 16, or the depth thereof. Thereby, it is hard that the movable amount of the rotary shaft 16 is adjusted by adjusting the position of the rotary valve 41 that is press-fitted into the rotary shaft 16.

On the other hand, the adjustable member 51 is structured so as to receive only external force in the direction of the rotary axis L. In other word, the strength of press-fitting between the adjustable member 51 and the insertion hole 50 is suppressed to a relatively small value. In addition, compressive load that is accompanied by compressing the refrigerant gas is not applied to the adjustable member 51. Thereby, the above-mentioned press-fitting strength is set to be as small as possible. Therefore, the movable amount of the rotary shaft 16 is easily adjusted.

A method of adjusting a rotary machine according to a second preferred embodiment of the present invention will now be described with reference to FIGS. 3, 4A and 4B. In the second embodiment, a variable displacement piston type compressor for use in a vehicle air conditioning apparatus is adopted as the rotary machine. In each of FIGS. 3 through 4B, a left side of the drawing is a front side and a right side thereof is a rear side. Also, in the second embodiment, only difference between the second embodiment and the first embodiment is described. The same reference numerals of the first embodiment are applied to the substantially same components in the second embodiment, and the overlapped description is omitted.

Figure 3:
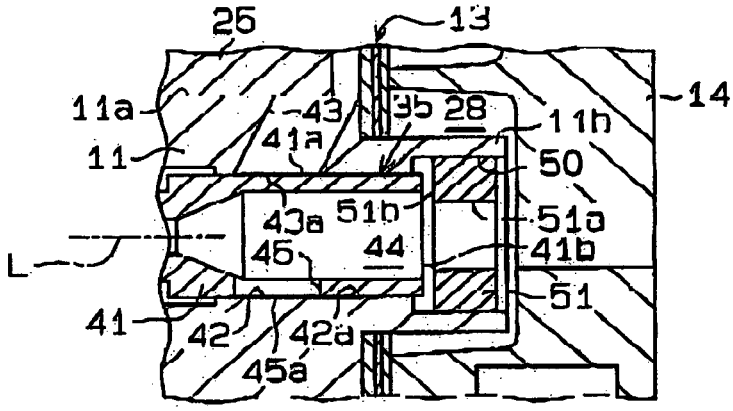
FIG. 3 is a partially enlarged sectional view illustrating a variable displacement piton type compressor that is applied to a second preferred embodiment of the present invention.

As shown in FIG. 3, in the present embodiment, the adjustable member 51 is fixedly press-fitted into the cylinder block 11.

Specifically, the insertion hole 50 is formed in an extending portion 11*b* that extends rearward from the rear end surface of the cylinder block 11 so as to interconnect the valve accommodation chamber 42 with the suction chamber 28. The rearward sliding movement of the rotary shaft 16 is restricted when the movement restricting part 51*b* of the adjustable member 51 that is fixedly press-fitted into the insertion hole 50 contacts with the contacting part 41*b*.

Figure 4A:
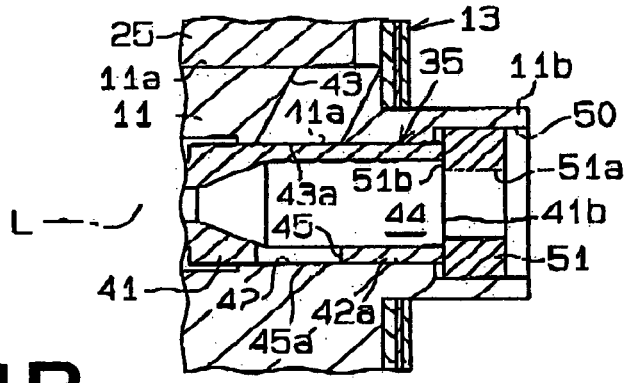
FIGS. 4A and 4B are views illustrating a procedure for adjusting the variable displacement piton type compressor according to the second preferred embodiment of the present invention.

When the adjustable member 51 is positioned in the insertion hole 50, as shown in FIG. 4A, the adjustable member 51 is press fitted into the insertion hole 50 from the rear side before the rear housing 14 is fixedly joined to the cylinder block 11. Subsequently, the adjustable member 51 is frontward press-fitted into the insertion hole 50, and thereby the contacting part 41*b* of the rotary valve 41 is frontward pressed through the movement restricting part 51*b*. The aforementioned means is a first process. Thus, the position of the adjustable member 51 that is press-fitted into the insertion hole 50 is temporality set to a reference position in such a manner that the sliding movement of the rotary shaft 16 is restricted, namely, the movable amount of the rotary shaft 16 becomes zero in the direction of the rotary axis L.

Figure 4B:
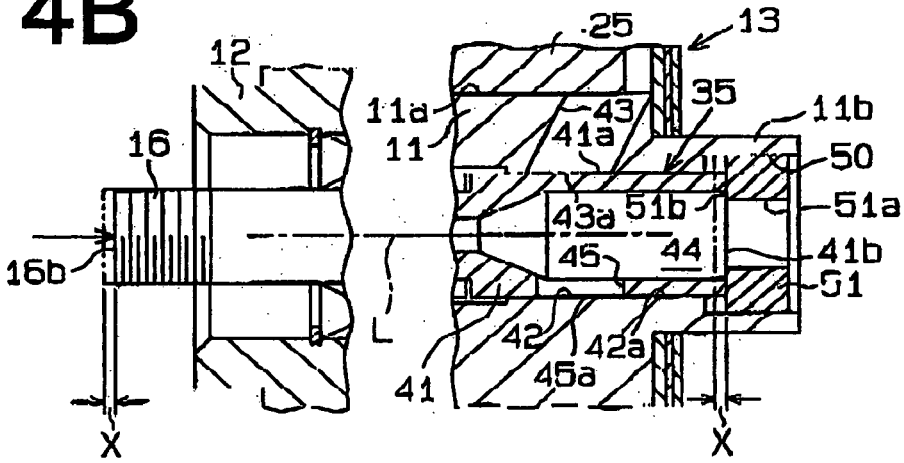

From the state of FIG. 4A, as shown in FIG. 4B, in a similar manner to the first preferred embodiment, when the front end surface 16*b* of the rotary shaft 16 is rearward pressed, the adjustable member 51 is moved into the insertion hole 50 so as to slide along the direction of the rotary axis L. Thereby, the clearance is set to the predetermined amount X. The aforementioned means is a second process.

In the present embodiment, the similar effects (1), (2), (3), (5) and (6) of the first embodiment are substantially obtained.

A method of adjusting a rotary machine according to a third preferred embodiment of the present invention will now be described with reference to FIGS. 5, 6A and 6B. In the third embodiment, a variable displacement piston type compressor for use in a vehicle air conditioning apparatus is adopted as the rotary machine. In each of FIGS. 5 through 6B, a left side of the drawing is a front side and a right side thereof is a rear side. Also, in the third embodiment, only difference between the third embodiment and the first embodiment is described. The same reference numerals of the first embodiment are applied to the substantially same components in the third embodiment, and the overlapped description is omitted.

Figure 5:
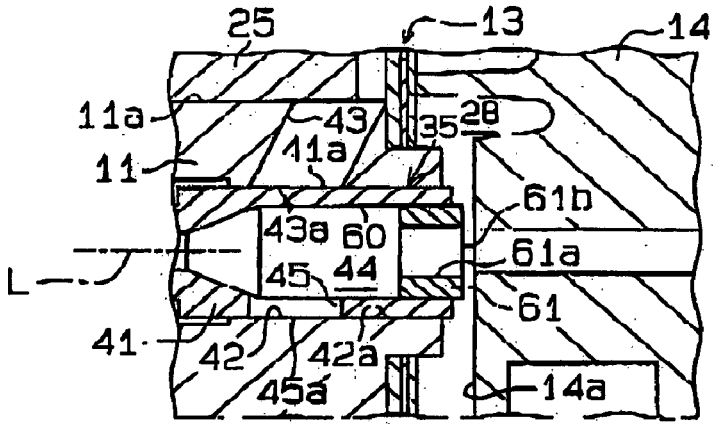
FIG. 5 is a partially enlarged sectional view illustrating a variable displacement piton type compressor that is applied to a third preferred embodiment of the present invention.

As shown in FIG. 5, in the present embodiment, the adjustable member 51 is not fixedly press-fitted to the compressor housing side, but is fixedly press-fitted to the rotary valve 41 on the rotary shaft side.

Specifically, in a port 60 that forms the inside space 44 of the rotary valve 41, a cylindrical adjustable member 61 that is made of metallic material of aluminum series and that is formed separately from the rotary valve 41 is fixedly press-fitted. A through hole 61*a* is formed in the middle portion of the adjustable member 61 so as to extend in the direction of the rotary axis L and permits the refrigerant gas to be introduced from the external refrigerant circuit to the suction chamber 28. The adjustable member 61 is placed in such a manner that a rear end surface 61*b* of the adjustable member 61 protrudes rearward from the rear end surface of the rotary valve 41.

In the present embodiment, a front surface 14*a* of the rear housing 14 forms a part or the suction chamber 28 and faces frontward in the suction chamber 28. The front surface 14*a* restricts rearward sliding movement of the rotary shaft 16 when the front surface 14*a* contacts with the rotary shaft 16. The front surface 14*a* serves as a movement restricting part. Also, the rear end surface 61*b* of the adjustable member 61 serves as a contacting part for contacting with the movement restricting part.

When the adjustable member 61 is positioned to the port 60 of the rotary valve 41, the adjustable member 61 is first press-fitted into the port 60 to a shallow position compared to a finished state that the rear housing 14 is joined to the cylinder block 11.

Figure 6A:
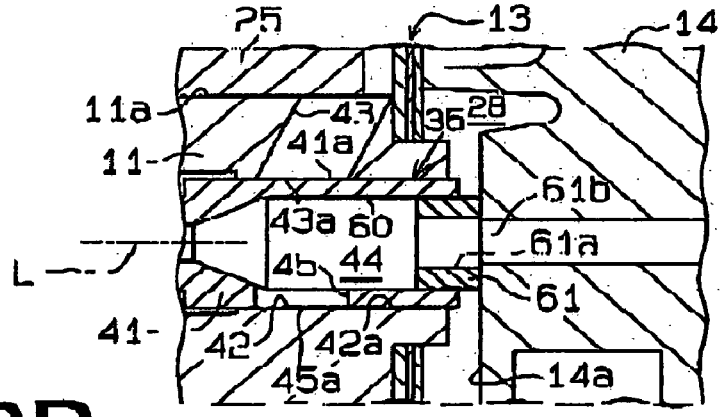
FIGS. 6A and 6B are views illustrating a procedure for adjusting the variable displacement piton type compressor according to the third preferred embodiment of the present invention.

Subsequently, as shown in FIG. 6A, the rear housing 14 and the cylinder block 11 are placed in such a manner that the front surface 14*a* of the rear housing 14 faces the rear surface of the cylinder block 11. In the state of FIG. 6A, the rear housing 14 is fixedly joined to the cylinder block side by bolting the through bolt 20, which is shown in FIG. 1, in such a manner that the front surface 14*a* presses the rear end surface 61*b* frontward. The aforementioned means is a first process. Note that the front surface 14*a* serves as a movement restricting part and that the rear end surface 61*b* serves as a contacting part. Thus, the position of the adjustable member 61 that is press-fitted into the port 60 is temporality set to a reference position in such a manner that the rearward sliding movement of the rotary shaft 16 is restricted, namely, the movable amount of the rotary shaft 16 becomes zero.

Figure 6B:
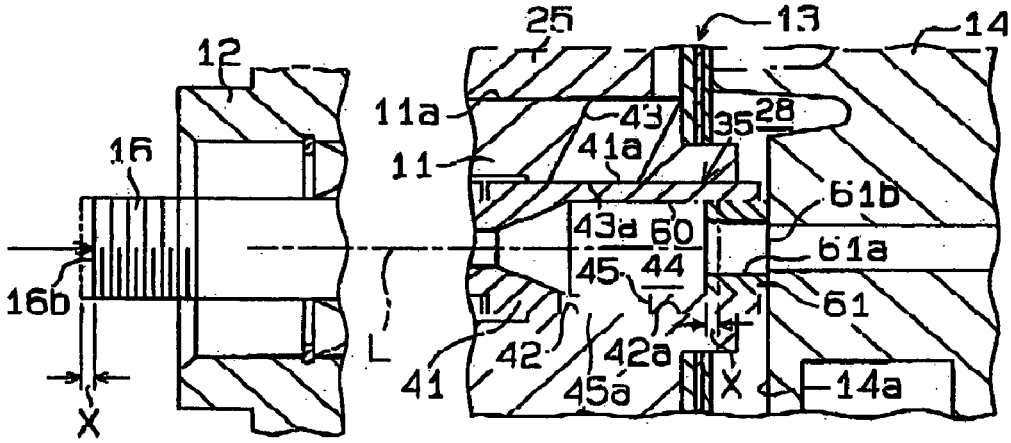
Figure 7A:
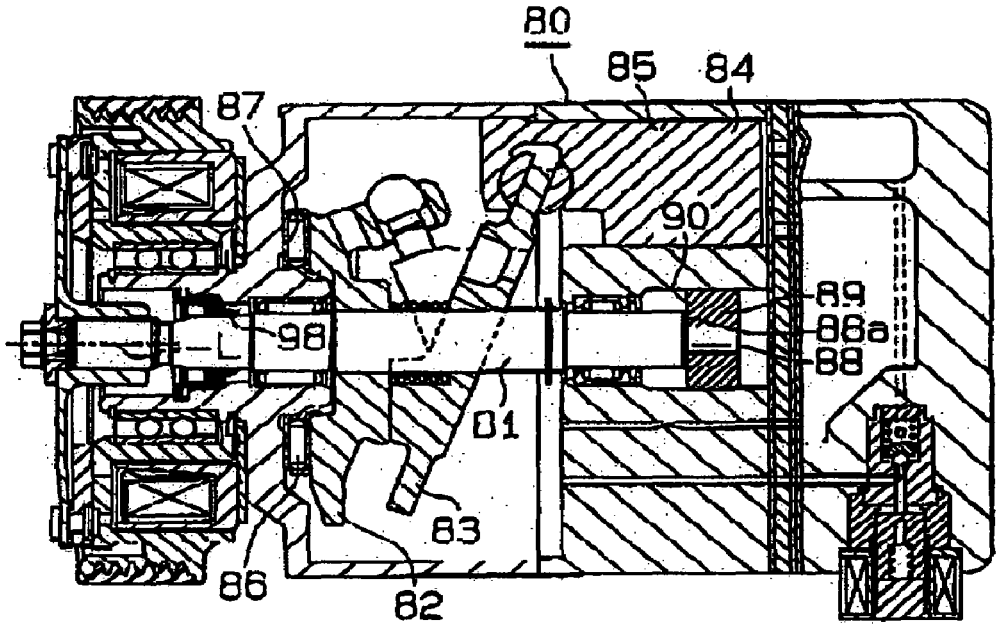
FIG. 7A (PRIOR ART)
FIG. 7A is a longitudinal sectional view illustrating a prior art piton-type compressor.
Figure 7B:
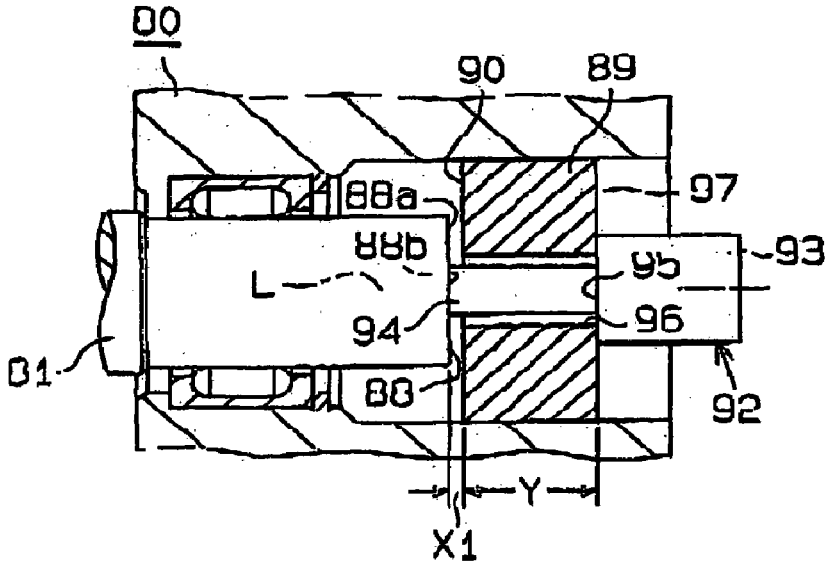
FIG. 7B (PRIOR ART)
FIG. 7B is a partially enlarged longitudinal sectional view illustrating the prior art piton-type compressor of FIG. 7A.

From the state of FIG. 6A, as shown in FIG. 6B, in a similar manner to the first preferred embodiment, when the front end surface 16*b* of the rotary shaft 16 is rearward pressed, the adjustable member 61 is moved into the port 60 so as to slide along the direction of the rotary axis L. Thereby, the clearance is set to the predetermined amount X. The aforementioned means is a second process.

In the present embodiment, the similar effects (1) through (6) of the first embodiment are substantially obtained.

In the present invention, the following alternative embodiments are also practiced.

In the first and second preferred embodiments, the adjustable member 51 is press-fitted into the insertion hole 50. In alternative embodiments to the above embodiments, however, in the compressor housing 10, a protrusion is protruded from a rear surface of the cylinder block 11 or a front surface of the rear housing 14 that forms the suction chamber 26 in the direction of the rotary axis L. The adjustable member 51 is press-fitted around the protrusion so as to slide along the direction of the rotary shaft L.

In the third preferred embodiment, the adjustable member 61 is press-fitted into the port 60 of the rotary valve 41. In an alternative embodiment to the above embodiment, however, the rear end of the rotary valve, 41 extends rearward. In addition, the outside diameter and the inside diameter of the adjustable member 61 are increased, the adjustable member 61 is press-fitted around the outer circumferential surface of an extending portion of the rotary valve 41 so as to slide along the direction of the rotary axis L.

In the first preferred embodiments, the clearance is adjusted to the predetermined amount X by utilizing the adjustable member 51, which is fixedly press-fitted to the rear housing 14. Also, in the second preferred embodiment, the clearance is adjusted to the predetermined amount X by utilizing the adjustable member 51, which is fixedly press-fitted to the cylinder block 11. Further, in the third preferred embodiment, the clearance is adjusted to the predetermined amount X by utilizing the adjustable member 61, which is fixedly press-fitted to the rotary valve 41. In alternative embodiments to the embodiments, however, the adjustable members 51 and 61 are no longer needed, and the position of the rotary valve 41 that is press-fitted to the rotary shaft 16 is adjusted. Thereby, the clearance is adjusted to the predetermined amount X. In this case, clearance between the contacting part 41*b* of the rotary valve 41 and the front surface 14*a* of the rear housing 14, which contacts with the contacting part 41*b*, is the predetermined amount X. Note that the front surface 14*a* or the rear housing 14 serves as a movement restricting part.

In the above-mentioned preferred embodiments, the rotary valve 41 and the rotary shaft 16 are press-fitted to each other. In alternative embodiments to the above embodiments, however, the rotary valve 41 and the rotary shaft 16 are integrally formed with each other.

In the above-mentioned, preferred embodiments, the suction valve system mechanism 35, which includes the rotary valve 41, is adopted. In alternative embodiments to the above embodiments, however, the suction valve system mechanism is a reed valve-type.

In the above-mentioned preferred embodiments, the variable displacement piston type compressor which includes the swash plate 35 is adopted. In alternative embodiments to the above embodiments, however, a variable displacement piston type compressor which includes a wobble plate is adopted.

In the above-mentioned preferred embodiments, the variable displacement piston type compressor is adopted. In alternative embodiments to the above embodiments, however, the compressor is a fixed displacement piston type compressor that includes a single-head piston.

In the above-mentioned preferred embodiments, the variable displacement piston type compressor is a single-head piston type compressor. In alternative embodiments to the above embodiments, however, the compressor is a double-head piston type compressor.

In the above-mentioned preferred embodiments, the swash plate 23 is adopted as a cam plate. In alternative embodiments to the above embodiments, however, a wave cam is adopted as a cam, and the wave cam is used for a piston type compressor.

In the above-mentioned preferred embodiments, the compressor is a piston type. In alternative embodiments to the above embodiments, however, a compressor other than a piston type compressor is adopted. For example, a scroll type compressor or a vane type compressor is adopted.

Therefore, the present examples and embodiments are to be considered as illustrative and not restrictive and the invention is not to be limited to the details given herein but may be modified within the scope of the appended claims.

What is claimed is:

1. A method of adjusting a rotary machine including a housing, a rotary body and movement restricting means which is composed of a movement restricting part, and a contacting part, the rotary body being rotatably supported in the housing and having a rotary axis for rotation and an exposed portion which is exposed outside from the housing, the movement restricting means restricting a movable amount of the rotary body in a direction of the rotary axis to a predetermined amount when the movement restricting part and the contacting part contact with each other, the movement restricting means having an adjustable member, one of the movement restricting part and the contacting part being provided by the adjustable member that is fixedly press-fitted to one of the housing and the rotary body in the direction of the rotary axis, comprising the steps of:

press-fitting the adjustable member to one of the housing and the rotary body pressing the rotary body through the adjustable member to a reference position at which the movable amount of the rotary body becomes zero; and adjusting the movable amount of the rotary body in the direction of the rotary axis to the predetermined amount by varying a position of the adjustable member from the reference position by pressing the exposed portion of the rotary body against the adjustable member in a direction in which the movement restricting part and the contacting part move away from each other.

2. The method according to claim 1, wherein the adjustable member is the movement restricting part that is fixedly press-fitted to the housing, the contacting part being formed on the rotary body.

3. The method according to claim 1, wherein the adjustable member is the contacting part that is fixedly press-fitted to the rotary body, the movement restricting part being formed on the housing.

4. The method according to claim 1, wherein the exposed portion is provided to receive power from an external drive source.

5. The method according to claim 1, wherein the housing includes at least a first housing component and a second housing component which are fixedly joined to each other, the rotary body being rotatably supported in the first housing component, the second housing component being adjoined to the first housing component, the press-fitting step and the pressing step comprising:

press-fitting the adjustable member to one of the second housing component; and pressing the rotary body at the reference position by pressing the adjustable member against the other of the second housing component and the rotary body when the first housing component and the second housing component are fixedly joined to each other.

6. The method according to claim 1, wherein the housing includes at least a first housing component and a second housing component which are fixedly joined to each other, the rotary body being rotatably supported in the first housing component, the second housing component being adjoined to the first housing component, the press-fitting step and the pressing step comprising:

press-fitting the adjustable member to the first housing component ; and pressing the adjustable member against the rotary body to the reference position before the first housing component and the second housing component are fixedly joined to each other.

7. The method according to claim 1, wherein the housing defining a cylinder bore and a suction pressure region, the piston being accommodated in the cylinder bore and being reciprocated therein in accordance with the rotation of the rotary shaft that serves as the rotary body, thereby a compression mechanism being accommodated in the housing for compressing refrigerant gas, the rotary shaft having an end to which a rotary valve is press-fitted, the rotary valve opening and closing a passage formed between the cylinder bore and the suction pressure region in accordance with synchronous rotation of the rotary shaft, the contacting part being formed on the rotary valve.

* * * * *